US005667957A

United States Patent [19]

Lushington et al.

[11] Patent Number: 5,667,957

[45] Date of Patent: Sep. 16, 1997

[54] XANTHATE SALTS AS CHEMICAL SENSITIZERS FOR SILVER HALIDES

[75] Inventors: Kenneth James Lushington; Henry James Gysling, both of Rochester, N.Y.

[73] Assignee: Eastman Kodak Company, Rochester, N.Y.

[21] Appl. No.: 653,736

[22] Filed: May 23, 1996

[51] Int. Cl.[6] ..... G03C 1/09

[52] U.S. Cl. ..... 430/603; 430/601; 430/610

[58] Field of Search ..... 430/601, 603, 430/610

[56] References Cited

U.S. PATENT DOCUMENTS

| | | | |
|---|---|---|---|
| 3,144,336 | 8/1964 | Herz | 430/603 |
| 4,030,928 | 6/1977 | Gahler et al. | 430/603 |
| 4,810,626 | 3/1989 | Burgmaier et al. . | |
| 5,210,002 | 5/1993 | Adin . | |
| 5,213,944 | 5/1993 | Adin . | |
| 5,391,727 | 2/1995 | Deaton . | |

*Primary Examiner*—Thorl Chea

*Attorney, Agent, or Firm*—Paul A. Leipold

[57] ABSTRACT

The invention is generally accomplished providing to a method of sensitizing silver halide grains comprising providing a silver halide grain and bringing said grain into contact with a compound of Formula I, $$C^+\{S_2COR\}^- \qquad \text{Formula I}$$

where

C is $NH_4^+$, $AR'_4{}^+$ or $M^+$

A is N, P, or As

R' is alkyl or aryl

M is Li, Na, or K, and

R is alkyl or aryl.

16 Claims, No Drawings

XANTHATE SALTS AS CHEMICAL SENSITIZERS FOR SILVER HALIDES

FIELD OF THE INVENTION

The invention relates to compounds utilized in chemical sensitization of silver halide compounds. It particularly relates to sulfur compounds utilized in chemical sensitization of silver halides utilized in black-and-white or color negative or color reversal film.

BACKGROUND OF THE INVENTION

Photographic silver halide materials are often chemically sensitized with one or more compounds containing labile atoms of gold, sulfur or selenium and the like to provide increased sensitivity to light and other sensitometric properties. Examples of typical chemically sensitized photographic silver halide emulsions are described in, for example, *Research Disclosure*, Item No. 308119, December 1989, Section III, and the references listed therein (Research Disclosure is published by Kenneth Mason Publications Ltd., Dudley Annex, 12a North Street, Emsworth, Hampshire PO 10 7DQ, England.) In *Research Disclosure*, Item No. 36544, September 1994, Section IV, page 510, there are a variety of chemical sensitizers disclosed.

Sulfur sensitizers are also disclosed in U.S. Pat. No. 5,415,992—Lok.

Thiourea compounds and sulfur sensitizers are disclosed in U.S. Pat. No. 4,810,626—Burgmaier et al and U.S. Pat. No. 5,213,944—Adin.

PROBLEM TO BE SOLVED BY THE INVENTION

However, while the prior chemical sensitizers have been successful, there is a continuing need for chemical sensitizers that are more efficient in providing additional sensitization to silver halide emulsions. There is also a continuing need for low cost sensitizers.

SUMMARY OF THE INVENTION

It is an object of the invention to provide improved chemical sensitizers for silver halide emulsions.

It is a further object of the invention to provide silver halide emulsions of greater sensitivity.

These and other objects of the invention generally are accomplished by a method of sensitizing silver halide grains comprising providing a silver halide grain and bringing said grain into contact with a compound of Formula I, $$C^+\{S_2COR\}^- \qquad \text{Formula I}$$

where

C is $NH_4^+$, $AR'_4{}^+$ or $M^+$

A is N, P, or As

R' is alkyl or aryl

M is Li, Na, or K, and

R is alkyl or aryl.

ADVANTAGEOUS EFFECT OF THE INVENTION

An advantage of the invention is highly sensitized silver halide emulsions.

DETAILED DESCRIPTION OF THE INVENTION

The invention xanthate salts have not been previously utilized as chemical sensitizers. Xanthate salts of aliphatic alcohols can be prepared by the reaction of carbon disulfide with a solution of hydroxide such as ammonium hydroxide or alkali metal hydroxide in alcohol. Its reaction may be set forth as:

$$ROH+KOH+CS_2 \rightarrow K(S_2COR)+H_2O$$

R is alkyl or aryl.

Preferred R materials include ethyl, methoxyethyl, isopropyl, n-hexyl, n-heptyl, n-decyl, and n-dodecyl for stable compounds with good sensitizing properties. Other preferred compounds are those of Formula I when:

$R = -(CH_2)_nER''_m$ — n = 1–20; E = O, S, Se, Te when m = 1; E = N, P, As, Sb, Bi when m = 2; R'' = alkyl, aryl or

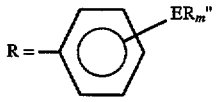

R'' = alkyl or aryl; E = N, P, As, Sb, Bi when m = 2; E = O, S, Se, Te when m = 1.

The formation of the xanthate salts is generally illustrated in S. R. Rao, *XANTHATES AND RELATED COMPOUNDS*, Marcel Dekker, N.Y., 1971 and E. R. T. Tiekink and G. Winter, Rev. Inorg. Chem., 12, 183 (1992): Inorganic Xanthates: A Structural Perspective.

Xanthates of phenols have been prepared by a similar route in a nonaqueous solvent such as dioxane:

$$HO\text{-}2,6\text{-}Me_2C_6H_4+KOH+CS_2 \xrightarrow{\text{dioxane}} K(S_2CO\text{-}2,6\text{-}Me_2\text{—}C_6H_4)+H_2O$$

H. W. Chen, Ph.D. Thesis, Case Western Reserve Univ., 1977: Synthesis, Reactions and Crystal Structures of Arylxanthates and Dithiophosphate Complexes.

The xanthate salts of the invention may be added to a silver halide emulsion at various stages during emulsion preparation and finishing. The xanthates may be added during emulsion formation, or they may be added after emulsion formation and after washing of the emulsion. They may be added prior to a heat cycle for chemical sensitization or they may be added during the heat cycle after the emulsion has been brought to an increased temperature. It is preferred that they be added either prior to or during the sensitization cycle. The heat cycle is preferably carried out at a temperature of between about 30° and 90° C. with a preferred temperature of addition being between 40° and 70° C. The addition may take place prior to heating or after heating has taken place. The xanthate sensitizing compounds may be added singly or in combination with other sensitizing agents. They also may be added to a silver halide emulsion along with silver ion ligands and silver halide growth modifiers or stabilizers and the antifogging agents. Further, the xanthates of the invention may be added with other chemical sensitizing agents such as sulfur, selenium, or tellurium, or noble metal compounds such as those of gold, palladium, platinum, rhodium, or iridium compounds or with dopants such as iron, iridium, rhodium, ruthenium, or osmium complexes. They may be added in the presence of spectral, sensitizing dyes. The xanthates may be added during formation of silver halide grains, during the physical or chemical ripening stage, or in a separate step immediately prior to coating to form a photographic element.

This invention provides a process for chemical sensitizing a silver halide emulsion formed according to any of the processes Generally well known in the art. A double jet-type process is preferred. The silver halide grains can comprise mixed or single halide components and especially include chloride, bromide, iodide, iodochloride, iodobromide or chlorobromide grains. They can also be different morphologies such as cubic, octahedra, tabular, or tetradecahedral. The chemical sensitizers of the invention are also suitable for core shell emulsions in which the composition and properties of a silver halide grains core are significantly different than the silver halide composition and properties on the surface of the grains.

The double-jet process comprises adding an aqueous silver nitrate solution and an aqueous solution of one or more halides, for example, an alkali metal halide such as potassium bromide, potassium chloride, potassium iodide or mixtures thereof, simultaneously to a stirred solution of a silver halide protective colloid through two separate jets.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose and cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole and polyvinyl pyrazole can be used.

Acid-processed gelatin can be used, as well as lime-processed gelatin. Further, gelatin hydrolyzates and enzyme-hydrolyzed products of gelatin are also usable.

Surface-active agents may be incorporated in a photographic emulsion layer or in another hydrophilic colloid layer as a coating aid to prevent buildup of static charge, to improve lubrication properties, to improve emulsion dispersion, to prevent adhesion and to improve other properties.

A photosensitive material of the present invention may contain antifogging agents or emulsion-stabilizing agents such as, for example, azaindenes, disulfides, thionamides, azoles and the like.

The photographic silver halide emulsions as described can be used in photographic silver halide elements in any of the ways and for purposes known in the photographic art.

The photographic silver halide emulsions can be used and incorporated in photographic elements that are black and white, single color elements or multicolor elements. Multicolor elements contain dye image-forming units sensitive to each of the three primary regions of the visible spectrum. Each unit can be comprised of a single emulsion layer or of multiple emulsion layers sensitive to given regions of the spectrum. The layers of the element can be arranged in various orders as known in the art.

In the following discussion of suitable materials for use in emulsions and elements of the invention, reference will be made to *Research Disclosure*, Number 365 of September 1994. *Research Disclosure* is published by Kenneth Masons Publications Ltd., Dudley Annex, 12a North Street, Emsworth, Hampshire PO 10 7DQ, England. This publication will be identified hereafter by the term "Research Disclosure".

The silver halide emulsions of the invention can be used in elements that can be either negative-working or positive-working. The emulsions in which the described new chemical sensitizers can be used are described in, for example, *Research Disclosure* Sections I, II and III and the publications and patents cited therein. Useful vehicles for the emulsion layers and other layers of elements of the invention are described in *Research Disclosure* Section IX and the publications cited therein.

The described photographic emulsions can be used in color photographic elements with couplers as described in *Research Disclosure* Section X and the publications cited therein. The couplers can be incorporated in the elements and emulsions as described in *Research Disclosure* Section XI and ways known in the art.

The photographic elements and emulsions as described can contain addenda known to be useful in photographic elements and emulsions in the photographic art. The photographic elements and emulsions as described can contain, for example, brighteners (see *Research Disclosure* Section VI); antifoggants and stabilizers (see *Research Disclosure* Section VII); antistain agents and image dye stabilizers (see *Research Disclosure* Section X); light absorbing and scattering materials (see *Research Disclosure* Section II); hardeners (see *Research Disclosure* Section IX); coating aids (see *Research Disclosure* Section IX); plasticizers and lubricants (see *Research Disclosure* Section IX); antistatic agents (see *Research Disclosure* Section IX); matting agents (see *Research Disclosure* Section IX); and development modifiers (see *Research Disclosure* Section XVIII).

The photographic silver halide materials and elements as described can be coated on a variety of supports as described in *Research Disclosure* Section XV and the publications cited therein.

The photographic silver halide materials and elements as described can include coarse, regular and fine grain silver halide crystals or mixtures thereof and can be comprised of any photographic silver halides known in the photographic art.

The photographic silver halide materials as described can be spectrally sensitized by means and dyes known in the photographic art, such as by means of spectral sensitizing dyes as described in, for example, *Research Disclosure* Section V and the publications cited therein. Combinations of spectral sensitizing dyes are especially useful.

Photographic materials and elements as described can be exposed to actinic radiation, typically in the visible region of the spectrum, to form a latent image as described in *Research Disclosure* Section XVI and then processed to form a visible image as described in, for example, *Research Disclosure* Section XVIII using developing agents and other processing agents known in the photographic art. Processing to form a visible image, typically a dye image, includes the step of contacting the element with a developing agent, typically a color developing agent, to reduce developable silver halide and oxidize the developing agent. In a color material the oxidized color developing agent in turn reacts with couplers to yield a dye.

The photographic silver halide materials can also be used in physical development systems as described in *Research Disclosure* Section XVII, in image-transfer systems as described in *Research Disclosure* Section X, in dry development systems as described in *Research Disclosure* Section XVII and in printing and lithography materials as described in *Research Disclosure* Section XIX.

The photosensitive materials obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), amino-phenols (e.g., N-methyl-p-amino-phenol), 1-phenyl-3-pyrazolidones or ascorbic acids.

As color-developing agent, there can be used primary aromatic amine developing agents such as phenylenediamines (e.g., 4-amino-N,N-diethylaniline, 3-methyl-4-amino-N, N-diethylaniline, 4-amino-3 -methyl-N-hydroxyethylaniline, 3-methyl-4-amino-N-ethyl-N-hydroxyethylaniline, 3 -methyl-4-amino-N-ethyl-N-methanesulfonamido-ethylaniline and 4-amino-3-methyl-N-ethyl-N-methoxyethylaniline. In addition, the developing agents described in L. F. A. Mason, *Photographic Processing Chemistry* (Focal Press, 1966), pp. 226–229, as well as those described in U.S. Pat. Nos. 2,193,015 and 2,592,364 may be used.

A photographic emulsion useful in the present invention can be applied to many different silver halide photographic light-sensitive materials due to its high photographic sensitivity, contrast, and fog reduction. For example, it can be used in high speed black-and-white negative films, in X-ray films and in multilayer color negative films.

The invention is particularly suitable for use with tabular silver bromoiodide grains which find their preferred use in color negative films. In such films it is particularly important that higher speeds be obtained, as there is a continuing need for higher speed films for color negative photography.

The following examples illustrate the practice of this invention. They are not intended to be exhaustive of all possible variations of the invention. Parts and percentages are by weight unless otherwise indicated.

EXAMPLES

Example 1

SYNTHESIS OF POTASSIUM ETHYL XANTHATE, $K\{S_2COEt)$

A solution of 11.2 g KOH (200 mmol) in 300 ml of ethanol was prepared and cooled to −78° C. To this cold solution was added 100 ml of $CS_2$. The resulting clear yellow solution was then removed from the cold bath and allowed to come to room temperature with stirring. Concentration of this solution to 175 ml resulted in the deposition of a heavy yellow precipitate. The precipitate was filtered, air dried, and recrystallized from 75 ml of hot ethanol to give 18.4 g of $KS_2COEt$ ($C_3H_5KOS_2$) (Calcd. (Found), (M.W.=160.30): C, 22.48 (22.34); H, 3.14 (3.01); S, 40.01 (40.45).

Example 2

SYNTHESIS OF POTASSIUM ISOPROPYL XANTHATE, $K\{S_2CO\text{-}i\text{-}C_3H_7\}$ To a solution of 57 g (1.015 mole) of KOH in 1 L of i-propanol, 80 ml of $CS_2$ was added, resulting in the formation of a heavy precipitate. The reaction solution was diluted to 2 L with i-propanol and, after stirring for 1 hr., the precipitate was isolated by filtration and washed well with i-propanol and air dried. This product was recrystallized by dissolving in 1.25 L of hot i-propanol-water (4:1 by volume), adding 2 g of activated charcoal and filtering the solution. Concentration of the filtrate to 250 ml gave a crop of pale yellow solid (57.7 g; Calcd(Found) for $C_4H_7KOS_2$ (MW=173.33): C, 27.56(27.3); H, 4.05(4.1); S, 36.79(36.6) ); K, 22.43(22.2)).

Example 3

SYNTHESIS OF $KS_2CO\text{-}n\text{-}C_7H_{15}$

KOH (56 g) was dissolved in 1 L of n-heptanol with warming. The solution was then cooled to room temperature and 100 ml of $CS_2$ was added. This solution was stirred for 10 hours and then concentrated to 700 ml resulting in the deposition of a white solid. This material was isolated by filtration, washed with ether and vacuum dried (yield=84 g). This material was recrystallized from 1 L of hot isopropanol containing ca. 2 g of activated charcoal. After filtration and concentration to 700 ml, the white solid was isolated by filtration and washed with isopropanol and ether and vacuum dried to give 36.4 g of the pure salt (Calcd (Found) $C_8H_{15}KOS_2$, M.W.=230.43: C, 41.7 (41.6); H, 6.6(6.4); S, 27.8 (27.9)).

Example 4

SYNTHESIS OF $KS_2CO\text{-}n\text{-}C_{12}H_{25}$ 50 g of NaOH was added to 1L of 1-dodecanol containing 30 ml of water and the resulting solution was heated at 90° C. for 15 min. The solution was then filtered, cooled to 40° C. and 100 ml of $CS_2$ was added with stirring to the filtrate to give an immediate heavy gelatinous precipitate. The solution was stirred a further 30 min. and the solid was isolated by filtration and washed well with isopropanol and ether and air dried to give 130 g of white solid. The crude product was recrystallized from 450 ml of hot 2:1 isopropanol-methanol to give 39 g of analytically pure product (Calcd. (Found) for $C_{13}H_{25}KOS_2$ (MW=300.56): C, 51.95(51.7);H, 8.4(8.5); S, 21.3(21.6); K, 13.0 (12.6).

Example 5

SYNTHESIS OF $K\{S_2CO\text{-}n\text{-}C_{16}H_{33}\}$ 14 g of KOH was added to 300 g of hexadecanol which had been melted by heating to 60° C. After stirring for 15 minutes to dissolve all the KOH, 100 ml of $CS_2$ was added in portions. After the addition of the $CS_2$ the solution was stirred at 60° C. for 10 min. and then 900 ml of i-propanol was added and the solution was heated to 65° C. for 5 min. and filtered hot. A heavy white precipitate deposited from the filtrate as it cooled to room temperature. This solid was isolated by filtration, washed well with ether, air dried and recrystallized from 350 ml hot i-propanol to give 6.1 g. of the pure salt (Calcd.(Found) for $C_{17}H_{33}KOS_2$ (MW= 356.66): C, 57.2(57.9); H, 9.3(8.9);S, 18.0(18.2)).

Example 6

SENSITIZATION OF A MONODISPERSE AgBr TABULAR EMULSION WITH XANTHATE SALTS

A monodisperse AgBr tabular emulsion, prepared as taught in U.S. Pat. No. 5,147,771, with an equivalent circular diameter of 2.4 μm and a thickness of 0.138 μm was treated with the xanthate salts at a variety of levels and temperatures for 20 minutes as shown in TABLE 1. Once the chemical digestion was complete, the example emulsions were cooled and coated on a film support at 1614 mg Ag $m^{-2}$ and 3230 mg gel $m^{-2}$. A 1614 mg gel $m^{-2}$ overcoat was applied over the emulsion containing layers. The coatings were then dried and exposed(0.1 s, 365 nm source) through a graduated density step wedge, processed (6 min. at 20° C.) in KODAK Rapid X-ray Developer, washed and dried. Speeds are expressed as the relative exposure required to increase the measured density to 0.15 above fog.

TABLE 1

KS$_2$COR SENSITIZATIONS ON A MONODISPERSE AgBr TABULAR EMULSION

| Compound | Amount added μmole/mole Ag | Temperature | R | Relative Speed |
|---|---|---|---|---|
| (Control) None | — | — | — | 100 |
| $Na_2S_2O_2$ (Control) | 25 | 60 | | 380 |
| A (invention) | 25 | 40 | ethyl, $C_2H_5$ | 340 |
| B (invention) | 10 | 40 | isopropyl, i-$C_3H_7$ | 346 |
| B (invention) | 10 | 60 | isopropyl, i-$C_3H_7$ | 489 |
| C (invention) | 25 | 40 | n-$C_7H_{15}$ | 1380 |
| D (invention) | 25 | 60 | n-$C_{12}H_{25}$ | 645 |
| E (invention) | 40 | 65 | $CH_2CH_2OCH_3$ | 447 |

It is apparent the invention xanthate compounds A–E give a significant improvement in sensitivity of the emulsions compared with the raw emulsion.

Example 7

K{S$_2$COR} SENSITIZATIONS OF A RUN-DUMP TABULAR EMULSION

A tabular silver bromoiodide emulsion with a 1.4 μm equivalent circular diameter and a thickness of 0.12 μm and a 1.5% I run and 3% I dump was prepared as taught in B. R. Johnson and P. J. Wightman, U.S. Pat. No. 5,164,292 (1992). This emulsion was then treated with the xanthate salt sensitizers shown in TABLE 2 using the same conditions given for TABLE 1.

TABLE 2 shows the increased performance that results from the xanthate salts of the invention.

TABLE II

SENSITOMETRIC DATA FOR K≡S$_2$COR□ SENSITIZED AgBrI RUN-DUMP TABULAR EMULSION

| R | Amount added μmole/mole Ag | Temperature | Relative Speed |
|---|---|---|---|
| — | — | — | 100 |
| $Na_2S_2O_3$ | 25 | 40 | 223 |
| ethyl, $C_2H_5$ | 25 | 40 | 490 |
| isopropyl, i-$C_3H_7$ | 10 | 40 | 219 |
| n-$C_7H_{15}$ | 25 | 40 | 208 |
| n-$C_{12}H_{25}$ | 25 | 60 | 138 |

The invention has been described in detail with particular reference to preferred embodiments thereof, but it will be understood that variations and modifications can be effected within the spirit and scope of the invention.

We claim:

1. A method of sensitizing silver halide grains comprising providing a silver halide grain and bringing said grain into contact with a compound of Formula I, $C^+\{S_2COR\}^-$ Formula I where C is $NH_4^+$, $AR'_4^+$ or $M^+$ A is N, P, or As R' is alkyl or aryl M is Li, Na, or K, and R is alkyl or aryl.

2. The method of claim 1 wherein M is an alkali metal cation selected from the group consisting of $Na^+$, and $K^+$.

3. The method of claim 1 wherein said Formula I compound is present in an amount between 0.1 and 100 μmol/mol Ag.

4. The method of claim 1 wherein said compound of Formula I chemically sensitizes said silver halide grain.

5. The method of claim 1 wherein said Formula I compound is present in an amount between 5 and 50 μmol/mol Ag.

6. The method of claim 1 wherein R is selected from the group consisting of ethyl, isopropyl, methoxyethyl, n-hexyl, n-heptyl, n-decyl, and n-dodecyl.

7. The method of claim 1 wherein R is $C_nH_{2n+1}$ wherein n=1 to 16.

8. The method of claim 1 wherein R is selected from $R = -(CH_2)_nER''_m$ n = 1–20
E = O, S, Se, Te; when m = 1
N, P, As, Sb, Bi; when m = 2
R" = alkyl, aryl or

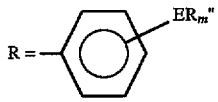

R" = alkyl or aryl
E = N, P, As, Sb, Bi when m = 2
E = O, S, Se, Te when m = 1.

9. A silver halide emulsion comprising providing silver halide grains and a compound of Formula I, $C^+\{S_2COR\}^-$ Formula I where C is $NH_4^+$, $AR'_4^+$ or $M^+$ A is N, P, or As R' is alkyl or aryl M is Li, Na, or K, and R is alkyl or aryl.

10. The emulsion of claim 9 wherein M is an alkali metal cation selected from the group consisting of $Na^+$, and $K^+$.

11. The emulsion of claim 9 wherein said Formula I compound is present in an amount between 0.1 and 100 μmol/mol Ag.

12. The emulsion of claim 9 wherein said compound of Formula I chemically sensitizes said silver halide grain.

13. The emulsion of claim 9 wherein said Formula I compound is present in an amount between 5 and 50 μmol/mol Ag.

14. The emulsion of claim 9 wherein R is selected from the group consisting of ethyl, isopropyl, methoxyethyl, n-hexyl, n-heptyl, n-decyl, and n-dodecyl.

15. The emulsion of claim 9 wherein R is $C_nH_{2n+1}$ wherein n=1 to 16.

16. The emulsion of claim 9 wherein R is selected from $R = -(CH_2)_nER''_m$ n = 1–20
E = O, S, Se, Te; when m = 1
N, P, As, Sb, Bi; when m = 2
R" = alkyl, aryl or

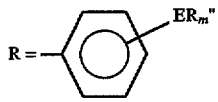

R" = alkyl or aryl
E = N, P, As, Sb, Bi when m = 2
E = O, S, Se, Te when m = 1.

* * * * *